US009431182B2

(12) United States Patent
Kim et al.

(10) Patent No.: US 9,431,182 B2
(45) Date of Patent: Aug. 30, 2016

(54) DOUBLE CONTACT POINT SWITCH AND A MAGNETIC CONNECTOR HAVING THE DOUBLE CONTACT POINT SWITCH

(71) Applicant: SPS Inc., Daejeon (KR)

(72) Inventors: Jung Gyo Kim, Daejeon (KR); Eun-Min Jeon, Daejeon (KR); Dae-Young Youn, Seoul (KR); Hyun-Jun Kim, Daejeon (KR)

(73) Assignee: SPS INC. (KR)

( * ) Notice: Subject to any disclaimer, the term of this patent is extended or adjusted under 35 U.S.C. 154(b) by 0 days.

(21) Appl. No.: 14/606,264

(22) Filed: Jan. 27, 2015

(65) Prior Publication Data

US 2016/0006187 A1 Jan. 7, 2016

(30) Foreign Application Priority Data

Jan. 17, 2014 (KR) ..... 20-2014-0000383 U

(51) Int. Cl.

| | |
|---|---|
| ***H01R 13/70*** | (2006.01) |
| ***H01R 33/96*** | (2006.01) |
| ***H01H 1/58*** | (2006.01) |
| ***H01R 13/703*** | (2006.01) |
| *H01R 13/62* | (2006.01) |
| *H01R 103/00* | (2006.01) |
| *H01R 13/24* | (2006.01) |

(52) U.S. Cl.

CPC ..... *H01H 1/58* (2013.01); *H01R 13/7038* (2013.01); *H01R 13/2421* (2013.01); *H01R 13/6205* (2013.01); *H01R 2103/00* (2013.01)

(58) Field of Classification Search

CPC .... H01R 13/70; H01R 13/71; H01R 13/713; H01R 13/2421; H01R 13/7036; H01R 33/96; H01R 13/6205; H01R 2103/00; H01R 33/955

See application file for complete search history.

(56) References Cited

U.S. PATENT DOCUMENTS

| | | | | |
|---|---|---|---|---|
| 3,915,536 | A * | 10/1975 | Glantz | H01R 33/962 439/188 |
| 6,224,407 | B1 * | 5/2001 | Duquerroy | H01R 13/6315 439/188 |
| 6,506,082 | B1 * | 1/2003 | Meek | H01R 13/2421 439/700 |
| 6,533,593 | B1 * | 3/2003 | Ishii | H01R 13/71 200/51.1 |
| 6,937,045 | B2 * | 8/2005 | Sinclair | G01R 1/0466 324/755.05 |
| 7,311,526 | B2 | 12/2007 | Rohrbach et al. | |
| 7,322,861 | B2 * | 1/2008 | Pavlovic | B60N 2/01508 349/34 |
| 8,523,579 | B2 * | 9/2013 | Johnston | H01R 13/2421 439/66 |
| 8,758,066 | B2 * | 6/2014 | Zhou | G01R 1/06722 439/700 |
| 8,758,067 | B2 * | 6/2014 | Rathburn | H01R 12/52 439/66 |
| 8,911,266 | B2 * | 12/2014 | Kawate | G01R 1/0483 439/700 |
| 9,048,556 | B2 * | 6/2015 | Morinari | |
| 2003/0060069 | A1 * | 3/2003 | Duquerroy | H01R 24/50 439/188 |

(Continued)

*Primary Examiner* — Gary Paumen

(74) *Attorney, Agent, or Firm* — Cantor Colburn LLP

(57) ABSTRACT

Provided are a double contact point switch and a magnetic connector having the same. The double contact point switch includes: a pin part; an additional terminal part; and an elastic part applying elastic force to the pin part, wherein the pin part includes a front contact point and a rear contact point, the pin part moves rearward when external force is applied to the front contact point of the pin part and again moves forward when the external force of the front contact point disappears, by the elastic part, and the rear contact point contacts the additional terminal part when the pin part moves rearward. As a result of this configuration, it is possible to confirm whether or not a contact of a magnetic connector was made without installing a separate signal terminal in the magnetic connector.

2 Claims, 6 Drawing Sheets

(56) References Cited

U.S. PATENT DOCUMENTS

2010/0221940 A1* 9/2010 Hoyack ..... H01R 24/44
439/188

2011/0230105 A1* 9/2011 Hsu ..... G01R 1/0466
439/824

2014/0057500 A1* 2/2014 Morinari ..... H01R 13/2421
439/700

* cited by examiner (a)

(b)

DOUBLE CONTACT POINT SWITCH AND A MAGNETIC CONNECTOR HAVING THE DOUBLE CONTACT POINT SWITCH

TECHNICAL FIELD

The present device relates to a double contact point switch and a magnetic connector having the same, and more particularly, to a double contact point switch of which a pin part has two contact points, and a magnetic connector having the same.

BACKGROUND

When a power supplying apparatus (an apparatus supplying power to an electronic apparatus, such as an adaptor) is connected to an electronic apparatus, it may be connected to the electronic apparatus by a magnetic connector.

As an example of the magnetic connector for supplying power, there is a magnetic connector (hereinafter, referred to as a 'magnetic connector according to the related art') disclosed in U.S. Pat. No. 7,311,526 B2 (registered on Dec. 25, 2007).

FIG. 1 is a cross-sectional view of a magnetic connector according to the related art.

The magnetic connector is coupled by magnetic attractive force between magnets 130 and 170 mounted therein. Here, contact pins 120 of the magnetic connector may contact contact terminals 160 of an opposite side to transfer power or a signal. In addition, elastic parts such as springs 122 are installed below the contact pins 120 in order to allow the contact pins 120 to certainly contact the contact terminals at the time of coupling the magnetic connector.

When the power is supplied through the magnetic connector, a spark is generated at the moment at which a power terminal (a contact terminal supplying the power) of the power supplying apparatus contacts a power terminal of the electronic apparatus, thereby making it possible to damage the apparatus. Therefore, it is preferable that the power supplying apparatus starts to supply the power after a contact between the power supplying apparatus and the electronic apparatus is made. To this end, a means capable of confirming the contact with the electronic apparatus is required in the power supplying apparatus. In the power supplying apparatus according to the related art, a separate signal terminal S is installed in addition to two power supplying terminals V+ and V−, and it is confirmed through the signal terminal whether or not the contact with the electronic apparatus was made. Here, as a method of conforming whether or not the contact with the electronic apparatus was made, a method of confirming whether or not the contact with the electronic apparatus was made by performing data communication through the signal terminal S, a method of deciding that the contact with the electronic apparatus was made when a current or a voltage is measured through the signal terminal S, or the like, has been used.

However, when the separate signal terminal S is installed in addition to the power supplying terminals V+ and V−, a structure of the magnetic connector becomes complicated, and the magnetic connector may not be easily miniaturized.

SUMMARY

An object of the present device is to confirm whether or not a contact of a magnetic connector was made without installing a separate signal terminal in the magnetic connector.

In one general aspect, a double contact point switch includes: a pin part; an additional terminal part; and an elastic part applying elastic force to the pin part, wherein the pin part includes a front contact point and a rear contact point, the pin part moves rearward when external force is applied to the front contact point of the pin part and again moves forward when the external force of the front contact point disappears, by the elastic part, and the rear contact point contacts the additional terminal part when the pin part moves rearward.

The additional terminal part may have an elastic means allowing the additional terminal part to move rearward when external force is applied thereto.

The double contact point switch may further include a body part enclosing the pin part.

The body part and the pin part may be electrically connected to each other.

In another general aspect, a magnetic connector having a double contact point switch includes: a magnet; and the double contact point switch, wherein the double contact point switch includes a pin part, an additional terminal part, and an elastic part applying elastic force to the pin part, the pin part including a front contact point and a rear contact point, the pin part moving rearward when external force is applied to the front contact point of the pin part and again moving forward when the external force of the front contact point disappears, by the elastic part, and the rear contact point contacting the additional terminal part when the pin part moves rearward.

The additional terminal part may have an elastic means allowing the additional terminal part to move rearward when external force is applied thereto.

The double contact point switch may further include a body part enclosing the pin part.

The body part and the pin part may be electrically connected to each other.

The magnetic connector having a double contact point switch may further include a circuit allowing the supply of power to the pin part when the rear contact point and the additional terminal part contact each other to thereby be electrically connected to each other.

DETAILED DESCRIPTION OF MAIN ELEMENTS

Figure 1:
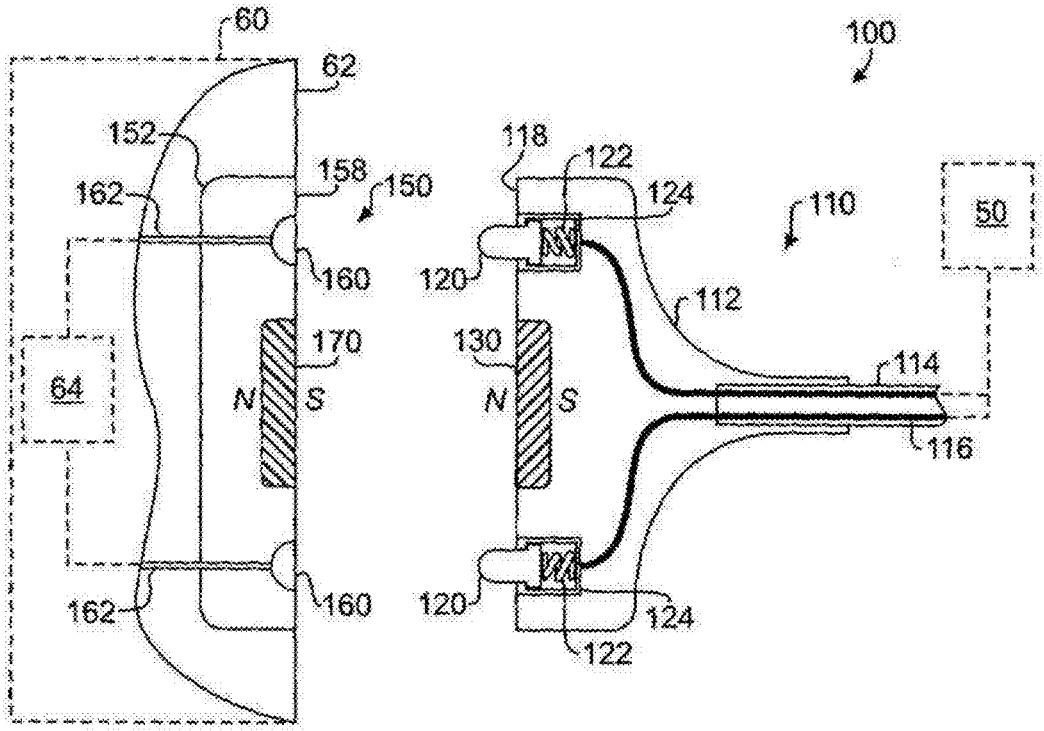
FIG. 1 Prior Art
FIG. 1 is a cross-sectional view of a magnetic connector according to the related art.

10: pin part
11: front contact point

12: rear contact point
13: catching jaw
14: spring
16: wing part
20: body part
21: body protrusion part
25: fixing part
30: additional terminal part
31: connecting part of additional terminal part
40: counter contact terminal
50: magnetic connector
51, 52: contact terminal
53: magnet
70: counter magnetic connector

DETAILED DESCRIPTION OF EMBODIMENTS

Hereinafter, a double contact point switch and a magnetic connector having the same according to the present device will be described in more detail with reference to the accompanying drawings.

Although a double contact point switch according to the present device may be implemented in several schemes, it may be implemented as in the following two exemplary embodiments.

First Exemplary Embodiment

Figure 2:
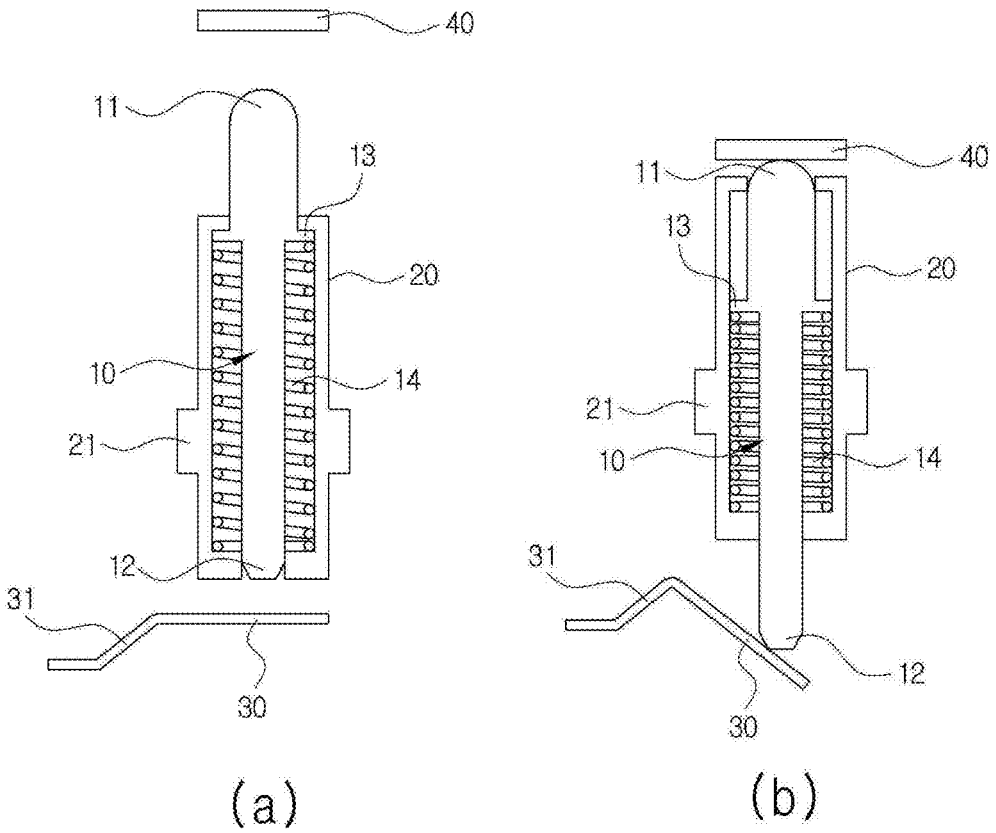
FIG. 2 is cross-sectional views of a double contact point switch according to a first exemplary embodiment of the present device.

FIG. 2 is cross-sectional views of a double contact point switch according to a first exemplary embodiment of the present device.

FIG. 2 shows (a) a form before a counter contact terminal presses the double contact point switch; and (b) a form after the counter contact terminal presses the double contact point switch.

A pin part 10 is provided with a front contact point 11 and a rear contact point 12. The pin part 10 is formed in a body part 20, and is provided with a catching jaw 13 that prevents the pin part 10 from being separated from the body part 20. The pin part 10 has a spring 14 formed at a rear thereof, and elastic force of the spring 14 serves to push the pin part 10 forward.

The pin part 10 has an additional terminal part formed at the rear thereof, wherein the additional terminal part 30 is coupled to a connecting part 31 thereof.

The counter contact terminal 40 is a contact terminal formed in a magnetic connector of an opposite side.

When the magnetic connector is coupled, the counter contact terminal 40 applies pressing force to the front contact point 11 of the pin part 10 while contacting the front contact point 11. In this case, the pin part 10 moves rearward, and the rear contact point 12 contacts the additional terminal part 30. Since the connecting part 31 of the additional terminal part 30 has elastic force, when external force is applied to the additional terminal part 30, the additional terminal part 30 moves rearward, and when the external force disappears, the additional terminal part 30 again moves forward.

Since the pin part 10 is made of a material having conductivity, when the pin part 10 contacts the additional terminal part 30 and the counter contact terminal 40 as shown in (b) of FIG. 2, the pin part 10 is electrically connected to the additional terminal part 30 and the counter contact terminal 40.

Here, an electric wire may be soldered directly to the pin part 10 in order to electrically connect the pin part 10 and the electric wire to each other. Alternatively, the spring 14 and the body part 20 are made of materials having conductivity, a body protrusion part 21 is formed on the body part 20, and the electric wire is connected to the body protrusion part 21, thereby making it possible to electrically connect the pin part 10 and the electric wire to each other. That is, the pin part 10 and the body part 20 are electrically connected to each other, thereby making it possible to easily electrically connect the electric wire and the pin part 10 to each other.

Second Exemplary Embodiment

Figure 3:
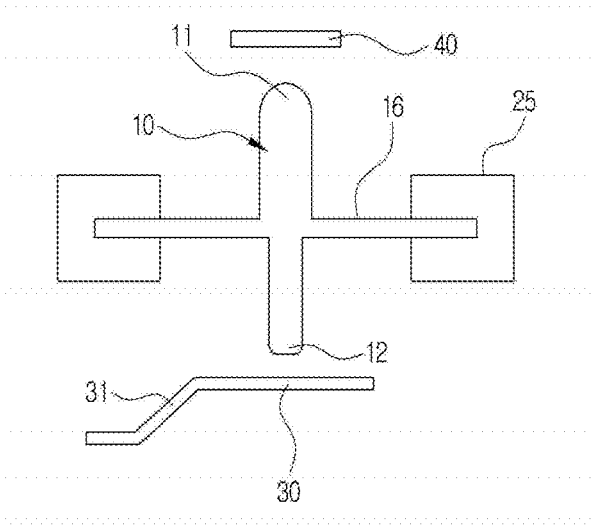
FIG. 3 is cross-sectional views of a double contact point switch according to a second exemplary embodiment of the present device.
Figure 3:
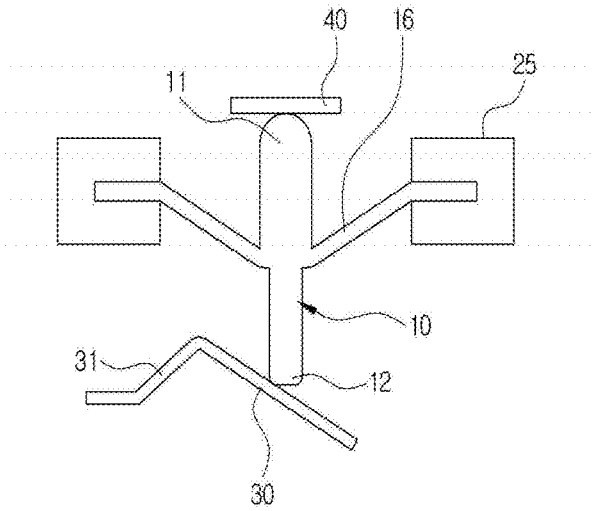

FIG. 3 is cross-sectional views of a double contact point switch according to a second exemplary embodiment of the present device.

FIG. 3 shows (a) a form before a counter contact terminal presses the double contact point switch; and (b) a form after the counter contact terminal presses the double contact point switch.

A pin part 10 is provided with a front contact point 11 and a rear contact point 12. The pin part 10 has two wing parts 16 lengthily formed at sides thereof, wherein the two wing parts 16 are inserted into and fixed to fixing parts 25. Since the wing part 16 is made of a material having elasticity, when external force is applied from the front to the pin part 10, the pin part 10 moves rearward, and when the force applied from the front disappears, the pin part 10 returns to its original position.

The pin part 10 has an additional terminal part 30 formed at the rear thereof, wherein the additional terminal part 30 is coupled to a connecting part 31 thereof.

The counter contact terminal 40 is a contact terminal formed in a magnetic connector of an opposite side.

When the magnetic connector is coupled, the counter contact terminal 40 applies pressing force to the front contact point 11 of the pin part 10 while contacting the front contact point 11 of the pin part 10. In this case, the pin part 10 moves rearward, and the rear contact point 12 contacts the additional terminal part 30. Since the connecting part 31 of the additional terminal part 30 has elastic force, when external force is applied to the additional terminal part 30, the additional terminal part 30 moves rearward, and when the external force disappears, the additional terminal part 30 again moves forward.

Since the pin part 10 is made of a material having conductivity, when the pin part 10 contacts the additional terminal part 30 and the counter contact terminal 40 as shown in (b) of FIG. 3, the pin part 10 is electrically connected to the additional terminal part 30 and the counter contact terminal 40.

Although the connecting part 31 of the additional terminal part is formed of a metal having elasticity to allow the additional terminal parts 30 of first and second exemplary embodiments to have elasticity, other means may also be used in order to allow the additional terminal part 30 to have the elasticity. For example, a coil spring may be attached to a rear surface of the additional terminal part 30 to allow the additional terminal part 30 to have the elasticity. In addition to the above-mentioned means, various means may be used.

In addition, although the spring 14 of a first exemplary embodiment and the wing part 16 of a second exemplary embodiment are installed in order to allow the pin part 10 to have elasticity and serve as an elastic part (a part applying the elasticity to the pin part), an elastic part by other methods may also be installed.

The meaning that the pin part 10 and the additional terminal part 30 have elastic force is that when external force is applied from the front, the pin part 10 and the additional terminal part 30 move rearward in proportion to the external force, and when the external force disappears, the pin part 10 and the additional terminal part 30 again move forward.

The reason why the pin part 10 and the additional terminal part 30 have the elastic force is in order to allow the pin part 10 to certainly contact the counter contact terminal 40 and the additional terminal part 30 when the magnetic connector is connected.

Figure 4:
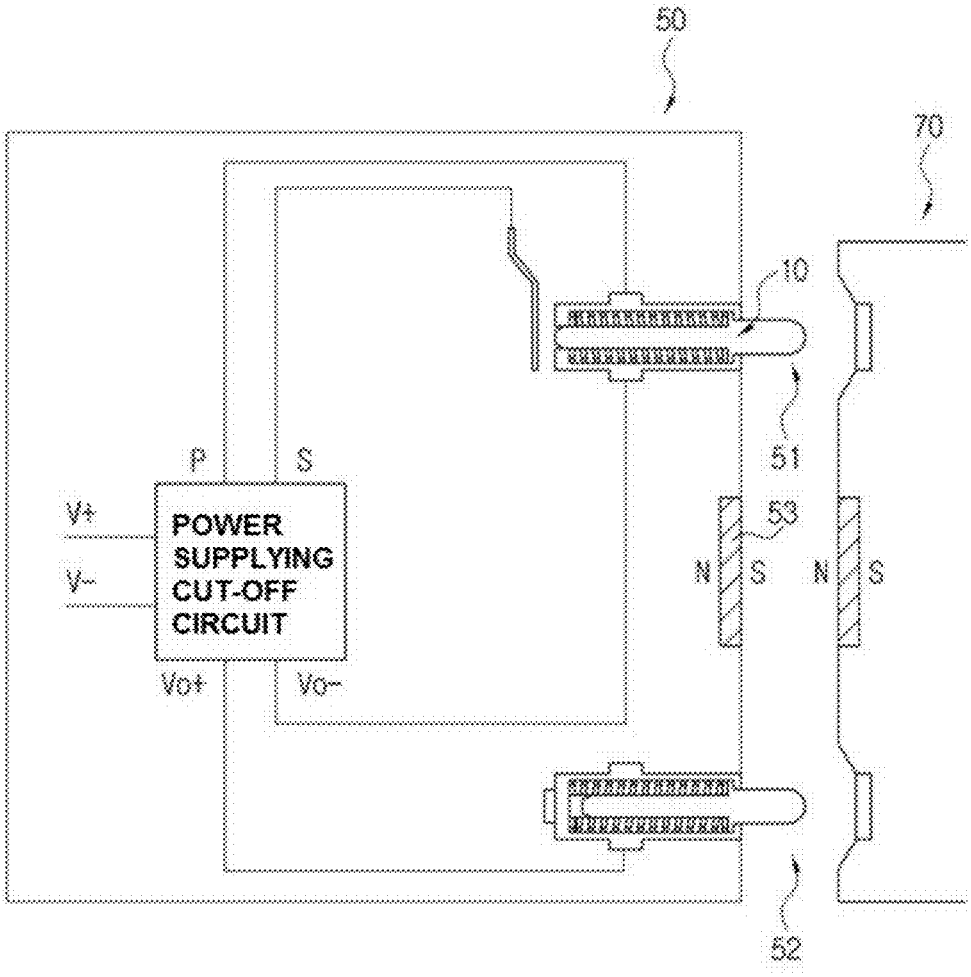
FIG. 4 is a conceptual diagram of a magnetic connector having a double contact point switch according to the present device.

FIG. 4 is a conceptual diagram of a magnetic connector having a double contact point switch according to the present device.

The magnetic connector 50 has a magnet 53 formed on a surface thereof, and magnetic attractive force acts between the magnet 53 and a magnet of a counter magnetic connector 70 to couple the two magnetic connectors to each other. A position of the magnet of the magnetic connector may be variously changed depending on a demand in a design.

The magnetic connector 50 of a power supplying apparatus has a power supplying cut-off circuit provided therein.

The power supplying cut-off circuit cuts off outputs to Vo+ and Vo− when inputs P and S are not electrically connected to each other, but allows the outputs to Vo+ and Vo− when the inputs P and S are electrically connected to each other. Here, it is preferable that the power supplying cut-off circuit allows the outputs to Vo+ and Vo− when a predetermined time elapses after the inputs P and S are not electrically connected to each other. Since the power supplying cut-off circuit is the well-known technology, a detailed description therefor will be omitted.

In the magnetic connector of FIG. 4, when a counter contact terminal of the counter magnetic connector 70 presses the pin part 10 of the double contact point switch to electrically connect the inputs P and S to each other, the outputs to the Vo+ and Vo− are allowed. Here, the outputs to the Vo+ and Vo supply power to an electronic apparatus through contact terminal 51 or 52 of the magnetic connector.

Although the double contact point switch is installed in the contact terminal 51 in an exemplary embodiment of FIG. 4, the double contact point switch may be installed in the contact terminal 52 or the double contact point switches may be installed in both of the contact terminals 51 and 52. In the case in which the double contact point switches are installed in both of the contact terminals 51 and 52, outputs from the two double contact point switches may pass through an AND circuit or an OR circuit and be then sent as inputs of the power supplying cut-off circuit.

In addition, in the case in which a transformer of the power supplying apparatus is always operated, electric power may be wasted. Therefore, the transformer may be operated only in the case in which the magnetic connector of the power supplying apparatus and a magnetic connector of the electronic apparatus are connected to each other using the double contact point switch.

Although the number of power supplying terminals of the magnetic connector is two (that is, positive (+) and negative (−) terminals) in FIG. 4, a larger number of power supplying terminals may be installed to allow power to be supplied even in the case in which the magnetic connector 50 is rotated by 180 degrees.

Figure 5:
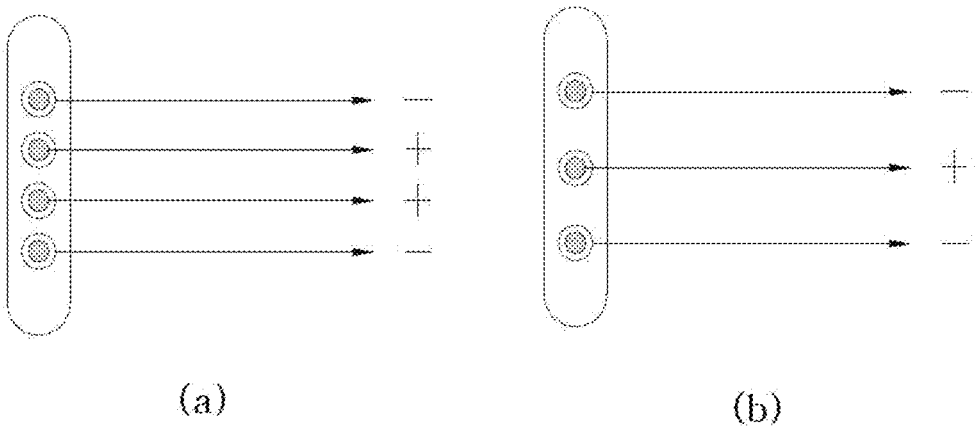
FIG. 5 is illustrative views of contact terminals of the magnetic connector.

FIG. 5 is illustrative views of contact terminals of the magnetic connector.

Four contact terminals are formed in (a) of FIG. 5, and three contact terminals are formed in (b) of FIG. 5.

Since the contact terminals are formed symmetrically to each other in (a) and (b) of FIG. 5, even though the magnetic connector 50 is rotated by 180 degrees in a state in which the counter magnetic connector 70 leaves as it is and is then connected to the counter magnetic connector 70, power may be supplied through the power supplying terminals.

Figure 6:
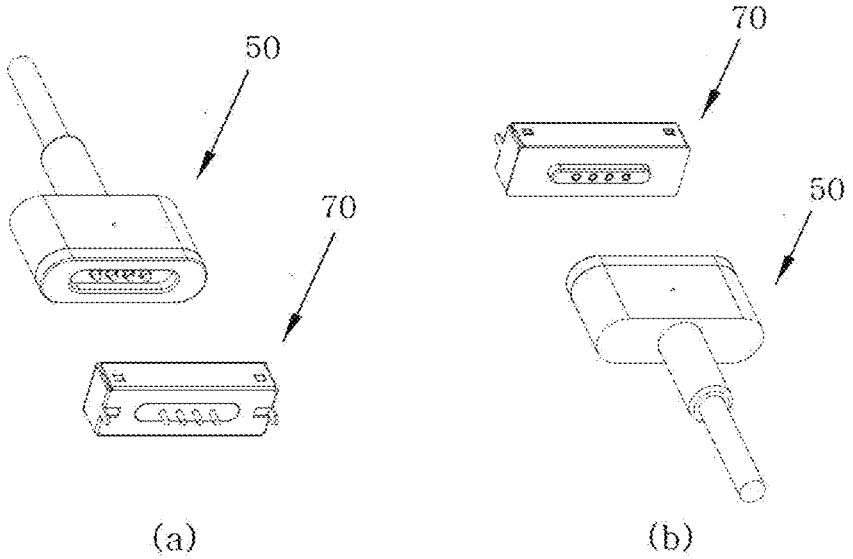
FIG. 6 is perspective views of the magnetic connector and a counter magnetic connector.

FIG. 6 is perspective views of the magnetic connector and a counter magnetic connector. In more detail, (a) and (b) of FIG. 6 are perspective views of the magnetic connector 50 having the contact terminals of (a) of FIG. 5 and the counter magnetic connector 70. (a) and (b) of FIG. 6 are perspective views viewed in opposite directions.

Figure 7:
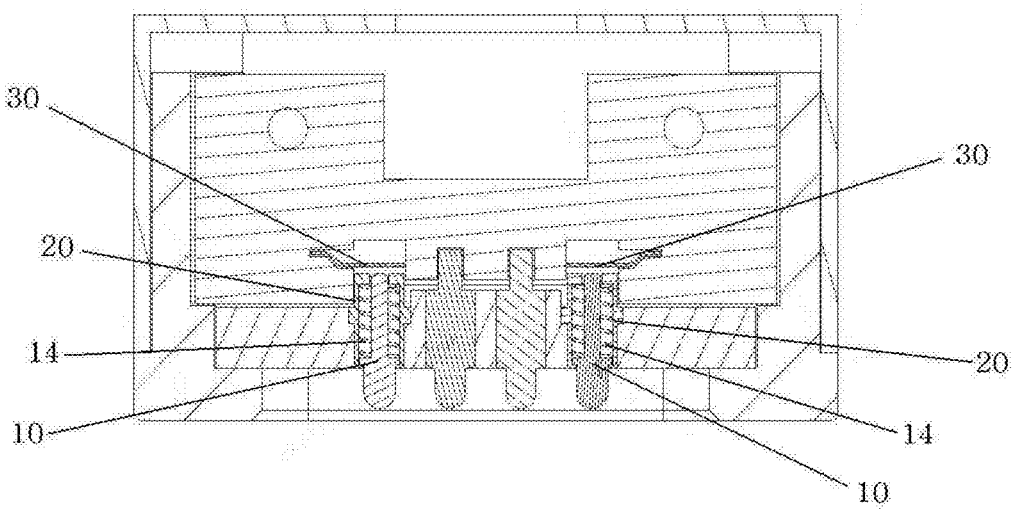
FIG. 7 is a cross-sectional view of the magnetic connector.

FIG. 7 is a cross-sectional view of the magnetic connector. In more detail, FIG. 7 is a cross-sectional view of the magnetic connector 50 of FIG. 6. Although the double contact point switches are installed in two contact terminals positioned at an outer side among the four contact terminals in FIG. 7, the double contact point switches may be installed in two contact terminals positioned at the center or be installed in all of the four contact terminals.

In FIG. 7, each of the double contact point switches includes the pin part 10, the spring 14, the body part 20, and the additional terminal part 30.

With the double contact point switch and the magnetic connector having the same according to the present device, it is possible to confirm whether or not a contact of a magnetic connector was made without installing a separate signal terminal in the magnetic connector.

What is claimed is:

1. A magnetic connector having a double contact point switch, comprising:

a magnet configured to magnetically attract a counter contact terminal; and a double contact point switch, wherein the double contact point switch includes:

a pin part having a front contact point and a rear contact point, wherein the pin part is configured to move rearwards with the front contact point contacted with the counter contact terminal when the counter contact terminal is magnetically attracted by the magnet, an additional terminal part configured to electrically contact the rear contact point of the pin part when the pin part moves rearwards, a body part surrounding and supporting the pin part, and an elastic part disposed inside the body part and surrounding the pin part, the elastic part configured to elastically bias the pin part frontwards, wherein the body part and the pin part electrically contact with each other, and the body part is electrically connected to a circuit allowing supply of power to the pin part so that, when the pin part moves rearwards and the rear contact point electrically contacts the additional terminal part, the circuit allows a power supply to the pin part through the body part.

2. The magnetic connector having a double contact point switch of claim 1, wherein the additional terminal part has an elastic means allowing the additional terminal part to move rearward when the rear contact point of the pin part contacts and an external force is applied thereto.

* * * * *